United States Patent [19]

Kawata et al.

[11] 4,376,162

[45] Mar. 8, 1983

[54] HEAT-DEVELOPABLE PHOTOSENSITIVE MATERIAL WITH ANTIHALATION LAYER

[75] Inventors: Ken Kawata; Isamu Itoh; Misao Awata; Takao Masuda, all of Minami-ashigara, Japan

[73] Assignee: Fuji Photo Film Co., Ltd., Kanagawa, Japan

[21] Appl. No.: 313,705

[22] Filed: Oct. 19, 1981

[30] Foreign Application Priority Data

Oct. 17, 1980 [JP] Japan ..... 55-145344

[51] Int. Cl.[3] ..... G03C 1/74

[52] U.S. Cl. ..... 430/510; 430/513; 430/517; 430/522; 430/618; 430/518

[58] Field of Search ..... 430/618, 510, 513, 517, 430/522, 518

[56] References Cited

U.S. PATENT DOCUMENTS

| | | | |
|---|---|---|---|
| 3,988,154 | 10/1976 | Sturmer | 430/510 |
| 4,081,278 | 3/1978 | Dedinas et al. | 430/517 |
| 4,201,590 | 5/1980 | Levinson et al. | 430/517 |
| 4,272,106 | 6/1981 | Auger | 430/517 |

*Primary Examiner*—Jack P. Brammer

*Attorney, Agent, or Firm*—Sughrue, Mion, Zinn, Macpeak & Seas

[57] ABSTRACT

A heat-developable photosensitive material is disclosed having a high image sharpness. The material is comprised of a heat-developable photosensitive layer which includes an organic silver salt, a photocatalyst, and a reducing agent. An antihalation layer is provided on the opposite face of the material with respect to the side intended for imagewise exposure. The antihalation layer contains a photosensitive halogen-containing compound which reduces the pH of the antihalation layer by photolysis and is colored with a dye which causes a change of color when the pH of the antihalation layer is reduced.

23 Claims, No Drawings

HEAT-DEVELOPABLE PHOTOSENSITIVE MATERIAL WITH ANTIHALATION LAYER

FIELD OF THE INVENTION

The present invention relates to a heat-developable photosensitive material, and particularly to a heat-developable photosensitive material which forms sharp images.

BACKGROUND OF THE INVENTION

Heat-developable photosensitive materials having a heat-developable photosensitive layer containing at least an organic silver salt, a photocatalyst and a reducing agent have been described, for example, in U.S. Pat. Nos. 3,152,904 and 3,457,075. These heat-developable photosensitive materials have advantages such as excellent gradation and high sensitivity as compared with other dry-type photographic processes, such as an electrophotographic process, a diazo photographic process, a foaming photographic process, or a heat-sensitive photographic process utilizing a coloring reaction of a leuco dye. In these heat-developable photosensitive materials, the image is obtained by imagewise exposure to light so that said photocatalyst is able to catalyze an oxidation-reduction reaction of said organic silver salt with the reducing agent, and thereafter heating (generally to 80° C. or more, and preferably to 120° C. or more). In this photosensitive system, since the photocatalyst having photosensitivity is used in a very small amount, there is hardly any interference when viewing, even if the sensitive material is allowed to remain exposed to light without carrying out fixation or stabilization after the development.

However, one of the faults of these heat-developable photosensitive materials is that the image becomes blurred by halation. In the prior silver halide photographic materials, which are subjected to a wet processing, this problem has been overcome by providing an antihalation layer, which is bleached or removed by liquid processing after exposure, located on the back of the base or between the base and the emulsion layer. However, an antihalation layer which is bleached or removed by liquid processing is not useful for heat-developable photosensitive materials, because the heat-developable photosensitive materials are intended to be processed by heating only.

Accordingly, in order to prevent halation of the heat-developable photosensitive materials, it is necessary to use an antihalation layer which can be bleached or removed by a dry processing. Techniques proposed heretofore include the following:

(1) A method which comprises using a colored layer capable of being mechanically stripped as the antihalation layer, as described in Japanese Patent Publication No. 33692/73.

(2) A method which comprises using a colored layer containing a dye which is bleached by heat as the antihalation layer, as described in U.S. Pat. Nos. 3,769,019, 4,033,948, 4,088,497, 4,153,463 and 3,821,001 and Japanese Patent Application (OPI) No. 56818/79 (the term "OPI" as used herein refers to a "published unexamined Japanese patent application").

(3) A method which comprises using a colored layer containing o-nitro-arylidene dyes or o-nitro-o-azaarylidene dyes, which are bleached by light, as the anti-halation layer, as described in Japanese Patent Application (OPI) No. 17833/79.

However, the method (1) requires an additional processing apparatus for the sole purpose of removing the antihalation layer, and there is also the possibility of damaging the base during the stripping operation. On the other hand, in method (2), there is a possibility of causing bleaching before the processing or during preservation, depending on the temperature, or there is a possibility of causing excess heat fogging. Further, in the method (3), there is a possibility of causing light discoloration of the heat-developable photosensitive layer because a large quantity of light is required for the decoloring, and there is a problem of selection of appropriate dyes having a desired absorptive wavelength, and synthesis of such dyes are difficult. Furthermore, the most serious disadvantage of the methods (2) and (3) is that decoloration of the colored antihalation layer requires a long period of time, i.e., the decoloration rate of the colored antihalation layer is low.

SUMMARY OF THE INVENTION

Accordingly, an object of the present invention is to provide a heat-developable photosensitive material comprising an antihalation layer having a high decoloration or discoloration rate.

Another object of the present invention is to provide a heat-developable photosensitive material having high image sharpness which comprises an antihalation layer which is very stable during preservation before the processing, the color of which can be easily changed into a color hue not interfering with viewing without causing heat fogging or light discoloration.

A further object of the present invention is to make possible selection from a wide range dyes which give an absorption characteristic in a desired wavelength to the antihalation layer.

The present invention has now attained the above described objects.

Particularly, the present invention is a heat-developable photosensitive material comprising a heat-developable photosensitive layer containing at least an organic silver salt, a photocatalyst and a reducing agent, and an antihalation layer provided on the opposite side of said heat-developable photosensitive layer with respect to the side intended for imagewise exposure. Substantial improvements in heat-developable photosensitive material has been obtained by using an antihalation layer which contains (1) a photosensitive halogen-containing compound which reduces the pH of said antihalation layer by photolysis and is colored with (2) a dye which causes a change of color when the pH of said antihalation layer is reduced.

DETAILED DESCRIPTION OF THE INVENTION

The photosensitive halogen containing compound as the component (1) in the colored composition used for the antihalation layer of the present invention is an organic compound which is decomposed by application of light to release a halogen radical or hydrohalogenic acid. Such compounds have been known and are described, for example, in U.S. Pat. No. 3,902,903, British Pat. No. 1,432,138 and Japanese Patent Application (OPI) Nos. 120328/75, 119624/75 and 24113/80, etc. In the present invention, the component (1) can be adopted by suitably selecting from these known photosensitive halogen containing compounds.

Typical examples of the photosensitive halogen containing compounds capable of using as component (1) in the present invention include the following compounds.

1. Compounds represented by the formula (I):

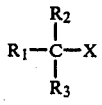

(I)

wherein X represents a halogen atom, $R_1$, $R_2$, and $R_3$, which may be identical or different, each can represent hydrogen, a halogen atom, a nitro group, an alkyl group having from 1 to 10 carbon atoms, an aryl group having from 6 to 14 carbon atoms, an alkylcarbonyl group having from 2 to 11 carbon atoms, an arylcarbonyl group having from 7 to 15 carbon atoms, an amide group substituted by an alkyl group having from 1 to 10 carbon atoms or an aryl group having from 6 to 14 carbon atoms, or a sulfonate group substituted by an alkyl group having from 1 to 10 carbon atoms or an aryl group having from 6 to 14 carbon atoms (the alkyl group and the aryl group in these groups may be substituted by halogen atoms, a hydroxyl group, a nitro group, alkyl groups, aryl groups, alkoxy groups, carbamate groups, carbonate groups, sulfonate groups and carboxylate groups, etc.), and $R_1$ and $R_2$ together can also form a cycloalkyl ring having from 3 to 8 carbon atoms by linking to each other.

Preferred examples of compounds included in formula (I) include carbon tetrabromide, tetrabromobutane, hexabromocyclohexane, α-chloro-p-nitrotoluene, iodoform, hexabromoethane, benzotrichloride, α-bromo-p-nitrotoluene, α-bromo-m-nitrotoluene, α,α'-dibromo-o-xylene, α,α'-dibromo-p-xylene, α,α,α',α'-tetrabromoxylene and tribromoethyl cinnamate; compounds represented by the formula:

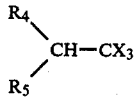

(wherein $R_4$ represents an alkyl group having from 1 to 10 carbon atoms or an aryl group having from 6 to 14 carbon atoms, $R_5$ represents a hydroxy group, an alkoxy group having from 1 to 10 carbon atoms, a carbamate group, a carbonate group, a sulfonate group, a phosphate group or a carboxylate group, and X represents a halogen atom; preferred examples of which include 2,2,2-tribromoethanol, 2,2,2-tribromoethyl cyclohexanecarbamate, 2,2,2-tribromoethyl benzenecarbamate, 2,2,2-tribromoethyl benzoate, 2,2,2-tribromoethylethyl carbonate, 1,1,1-trichloropropanol-2,2,2-trichloroethanol, 2,2-dibromo-2-chloro-1-phenylethanol, 2-methyl-1,1,1-tribromo-2-propanol, bis(2,2,2-tribromoethoxy)diphenylmethane, p-toluenesulfonyl tribromoethyl urethane, 2,2,2-tribromoethyl stearate, 2,2,2-tribromoethyl feroate and bis(2,2,2-tribromoethyl)succinate, etc.), compounds represented by the formula:

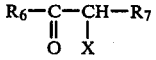

(wherein $R_6$ represents an amino group, an alkyl group having from 1 to 10 carbon atoms or an aryl group having from 6 to 14 carbon atoms, $R_7$ represents hydrogen, an alkyl group having from 1 to 10 carbon atoms, or an acyl group having from 1 to 10 carbon atoms, and X represents a halogen atom; preferred examples of which include 2-bromoacetophenone, 2-bromo-2-phenylacetophenone, 2-bromo-1,3-diphenyl-1,3-propanedione, α-bromo-2,5-dimethoxyacetophenone, α-bromo-γ-nitro-β-phenylbutyrophenone, α-iodo-γ-nitro-β-phenylbutyrophenone, 2-bromo-p-phenylacetophenone, 2-chloro-p-phenylacetophenone, 2-bromo-p-bromoacetophenone, 1,3-dichloroacetone and 2,2'-dichloro-4-chloromethylcarbonamidobenzophenone, etc.), compounds represented by the formula:

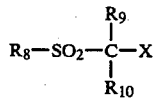

(wherein $R_8$ represents an aryl group having from 6 to 12 carbon atoms or a benzothiazole group, $R_9$ and $R_{10}$, which may be identical or different, each represents hydrogen, a halogen atom, an alkyl group having from 1 to 5 carbon atoms, or an amido group having from 1 to 11 carbon atoms, and X represents a halogen atom; preferred examples of which include 2-bromo-2-phenylsulfonylacetamide, 2-bromo-2-(p-tolylsulfonyl)acetamide, 2-tribromomethylsulfonylbenzothiazole, dibromomethylsulfonylbenzene and tribromomethylsulfonylbenzene, etc.), and compounds represented by the formula:

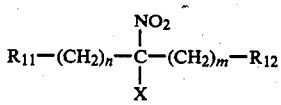

(wherein n and m each represents an integer of 1 to 5, $R_{11}$ and $R_{12}$ each represents —OH,

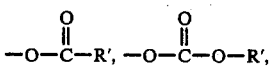

or $—SO_2—R'$ (wherein R' represents an alkyl group having from 1 to 5 carbon atoms on an aryl group having from 6 to 12 carbon atoms), and X represents a halogen atom; preferred examples of which include 2-bromo-2-nitro-1,3-propanediol, 1,3-dibenzoyloxy-2-bromo-2-nitropropane and 2-bromo-2-nitrotrimethylenebis(phenylcarbonate), etc.).

2. Compounds represented by formula (II):

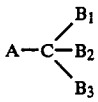

(II)

wherein A represents a 5- or 6-membered heterocyclic ring, which may have substituents, and be comdensed with a benzene ring and $B_1$, $B_2$, and $B_3$ each represent an atom selected from hydrogen, chlorine and bromine, provided that at least one of $B_1$, $B_2$, and $B_3$ is a chlorine atom or a bromine atom. Preferred examples of the substituents of the heterocyclic ring include halogen atoms, a hydroxyl group, a nitro group, alkyl groups, aryl groups, alkoxy groups, carbamate groups, carbonate groups, sulfonate groups and carboxylate groups, etc.

Preferred examples include the compounds described in U.S. Pat. No. 3,902,903 such as ω,ω,ω-tribromoquinalidine, ω,ω-dibromoquinaldine, 2-ω,ω,ω-tribromomethyl-4-methylquinaldine or ω,ω-dichloromethylquinoline, etc.

3. Compounds represented by formula (III):

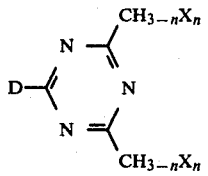

(III)

wherein D represents an alkyl group having from 1 to 5 carbon atoms, which may be substituted by halogen atoms or an aryl group having from 6 to 10 carbon atoms, X represents a halogen atom, and n represents an integer of 1 to 3.

Preferred examples thereof include 2,4-bis(tribromomethyl)-6-methyltriazine, 2,4,6-tris(dibromomethyl)triazine, 2,4,6-tris(tribromomethyl)triazine, 2,4,6-tris(trichloromethyl)triazine, 2,4-bis(trichloromethyl)-6-methyltriazine, and 2,4-bis(trichloromethyl)-6-phenyltriazine, etc.

4. Compounds represented by formula (IV)

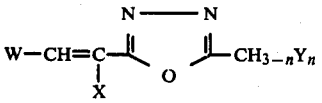

(IV)

wherein W represents a substituted or unsubstituted phenyl group or a substituted or unsubstituted naphthyl group, wherein the phenyl group may be substituted with halogen atoms, a nitro group, a cyano group, an alkyl group having from 1 to 3 carbon atoms or an alkoxy group having from 1 to 4 carbon atoms. Further, the phenyl group may have the structure

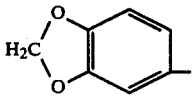

wherein two alkoxy groups form a ring. The number of substituents is 1 or 2 in the case of halogen atoms, and is 1 in other cases. X represents hydrogen, an alkyl group having from 1 to 3 carbon atoms, or a phenylgroup. Y represents a halogen atom. n represents an integer of 1 to 3.

Preferred examples of compounds of formula (IV) include the following compounds described in U.S. Pat. No. 4,212,970.

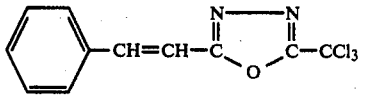

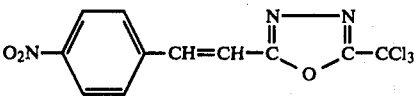

-continued

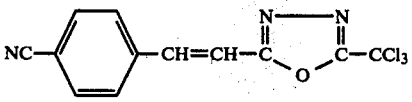

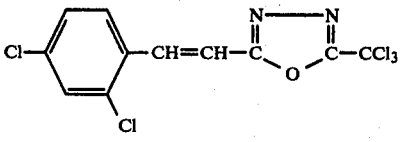

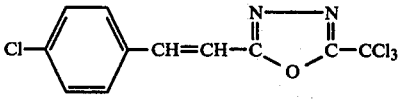

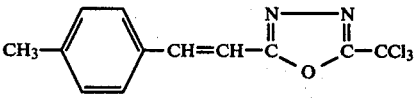

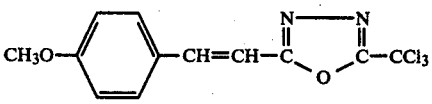

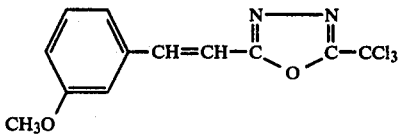

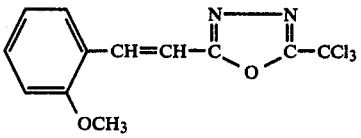

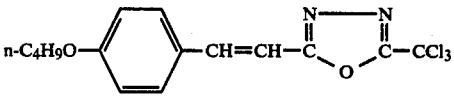

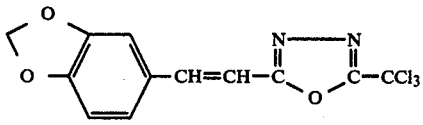

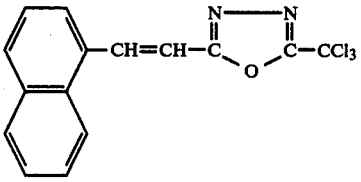

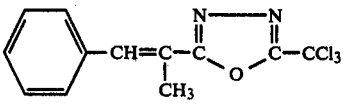

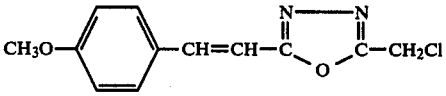

-continued

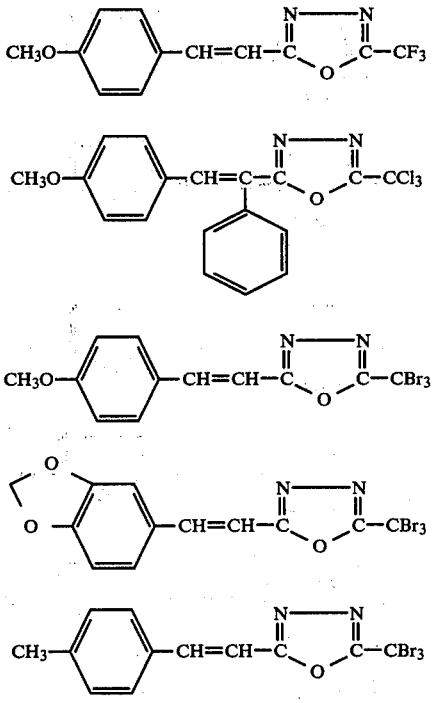

These foregoing photosensitive halogen containing compounds should be used in an amount sufficient to reduce the pH of the antihalation layer so that color hue of the dye included as component (2) causes a change of color by means of halogen radical or hydrochloric acid formed by photolysis, when exposed to light capable of absorbing in these photosensitive halogen-containing compounds. It is generally convenient to determine an optimum amount of the photosensitive halogen containing compound included in component (1) by applying to light a combination of it with the dye included as component (2) in various amounts. Generally, the component (1) is used in an amount of from 0.1 mol to 100 mols, and preferably from 0.5 mol to 10 mols, per mol of the component (2), by which the pH of the above described antihalation layer can be reduced to a degree sufficient to cause the change of color of the dye included as component (2).

The dye included as the component (2) of the present invention is a dye which has an absorption in the sensitive wavelength range of the heat-developable photosensitive layer in an ordinary state before thermal development, but has a property that the maximum wavelength thereof shifts in a shorter wavelength side or a longer wavelength side to cause the change of color when the pH of the antihalation layer is reduced (namely, when the foregoing component (1) is subjected to photolysis). The component (2) is selected such that the change of color is not an obstacle to viewing images, namely, the sensitive material after processing has a desired color. A preferred color hue after processing is no color, a light color or a blue color, and no color is particularly preferred. Accordingly, as the component (2), it is preferred to use a dye wherein the base side absorption thereof causes short-wavelength migration by hydrochloric acid released from the foregoing component (1) by photolysis to shift the maximum absorption wavelength beyond the visible range, by which it becomes colorless or light-colored, or causes long-wavelength migration by which it becomes blue. Examples thereof include dyes generally known as pH indicators. In addition, it is possible to use azo dyes and preferably phenylazo or naphthylazo dyes having a hydroxyl group on the othoposition or paraposition to the azo group. Dyes capable of using preferably as the component (2) of the present invention are described below.

(1) Cyanine
(2) Quinaldine Red
(3) Neutral Red
(4) Curcumin
(5) Haematoxylin
(6) Alizarin
(7) Methyl Orange
(8) Ethyl bis-2,4-dinitrophenyl acetate
(9) o-Cresolphthalein
(10) Phenolphthalein
(11) Thymolphthalein
(12) Tetrabromophenolsulfonphthalein
(13) Dibromodichlorophenolsulfonphthalein
(14) Thymolsulfonphthalein
(15) 1,4-Dimethyl-5-hydroxybenzenesulfonphthalein
(16) m-Cresolsulfonphthalein
(17) o-Cresolsulfonphthalein
(18) Dibromo-o-cresolsulfonphthalein.

In addition, there are compounds represented by formulae (V) and (VI), namely:

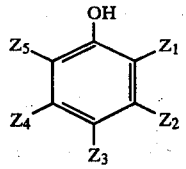

(V)

wherein $Z_1$, $Z_2$, $Z_3$, $Z_4$ and $Z_5$, which may be identical or different, each represents hydrogen, a halogen atom, a cyano group, —CH=N—OH, a carboxyl group, a sulfo group, an alkyl group (preferably that having 20 or less carbon atoms), an acyl group (preferably that having 20 or less carbon atoms), an alkoxy group (preferably having 20 or less carbon atoms), an amido group (preferably having 20 or less carbon atoms), a carbamoyl group (preferably having 20 or less carbon atoms), a sulfonyl group (preferably having 20 or less carbon atoms) a sulfonamido group (preferably having 20 or less carbon atoms), a sulfamoyl group (preferably having 20 or less carbon atoms), an aryl group (preferably a phenyl group) or a nitro group, provided that at least one of $Z_1$, $Z_2$, $Z_3$, $Z_4$ and $Z_5$ is a nitro group; and $Z_1$ and $Z_2$, or $Z_2$ and $Z_3$ together may form a ring (such as a naphthalene ring or a quinoline ring, etc. which may have the above described substituents) by linking to each other. Preferred examples thereof include the following compounds:

(19) p-Nitrophenol
(20) 2-{2-(2,4-Di-t-amylphenoxy)butanamido}-4-nitrophenol
(21) 2,5-Dinitrophenol
(22) 2,6-Di-t-butyl-4-nitrophenol
(23) 8-Hydroxy-5-nitroquinoline
(24) 2-Formyl-6-methoxy-4-nitrophenol

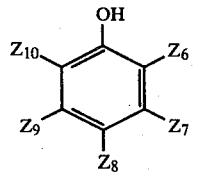

(VI)

wherein $Z_6$, $Z_7$, $Z_8$, $Z_9$ and $Z_{10}$ each represents the same atom or group as that described in formula (V), except that at least one of $Z_6$, $Z_7$, $Z_8$, $Z_9$ and $Z_{10}$ is not necessary to be a nitro group and one of $Z_6$ and $Z_8$ represents a phenylazo group, i.e.,

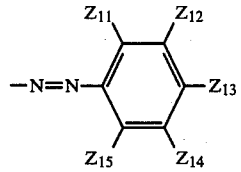

wherein $Z_{11}$, $Z_{12}$, $Z_{13}$, $Z_{14}$ and $Z_{15}$ each represents the same atom or group as that described in formula (V), except that at least one of $Z_{11}$, $Z_{12}$, $Z_{13}$, $Z_{14}$ and $Z_{15}$ is not necessary to be a nitro group. Preferred examples thereof include the following compounds;

(25) 4-Phenylazophenol
(26) 4-(2-Chlorophenylazo)phenol
(27) 4-(3-Chlorophenylazo)phenol
(28) 4-(4-Chlorophenylazo)phenol
(29) 4-(2,4-Dichlorophenylazo)phenol
(30) 4-(2,4,6-Trichlorophenylazo)phenol
(31) Na salt of 3-chloro-4-(4-hydroxyphenylazo)benzene-1-sulfonic acid
(32) Na salt of 2-(4-hydroxyphenylazo)benzene-1-sulfonic acid
(33) Na salt of 4-(4-hydroxyphenylazo)benzoic acid
(34) 4-(4-Carbamoylphenylazo)phenol
(35) 4-(4-Cyanophenylazo)phenol
(36) 4-(2,6-Dimethylphenylazo)phenol
(37) 4-(2-Methoxyphenylazo)phenol
(38) 4-(4-Methoxyphenylazo)phenol
(39) 2-Carbamoyl-4-(2,4-dichlorophenylazo)phenol
(40) 2-Chloro-4-(3-sulfamoylphenylazo)phenol
(41) 2-Carbamoyl-4-(4-methoxyphenylazo)phenol
(42) 2-Chloro-4-(3-sulfamoylphenylazo)phenol
(43) 2-Chloro-4-(4-cyanophenylazo)phenol
(44) 2-Cyano-4-phenylazophenol
(45) 5-Acetyl-2,4'-dihydroxyazobenzene
(46) 4-(2-Chlorophenylazo)-2-nitrophenol
(47) 3-Methoxy-4-phenylazophenol
(48) 2,4-Dichloro-6-phenylazophenol
(49) 4-Phenylazonaphthol
(50) 4-Phenylazo-2-sulfamoylnaphthol
(51) 5-Methylsulfonamido-4-phenylazo-2-sulfamoylnaphthol
(52) 2-Carbamoyl-4-(4-methoxyethoxy-3-sulfamoylphenylazo)naphthol
(53) 4-(2,4-Dichlorophenylazo)naphthol
(54) 3-Carbamoyl-1-(4-methoxyphenylazo)-2-naphthol
(55) Na salt of 3-(2-hydroxy-3-methoxyethylcarbamoylnaphtholazo)benzene-1-sulfonic acid
(56) Na salt of 2-(2-carbamoylphenylazo)naphthol-4-sulfonic acid
(57) 2-(2-Chlorophenylazo)-4-methoxynaphthol
(58) 2-(2,5-Dimethyl-4-sulfamoylphenylazo)-4-nitronaphthol
(59) 5-Methylsulonamido-4-(2-methylsulfonyl-4-nitrophenylazo)naphthol
(60) Na salt of 4-(hydroxynaphthylazo)benzene-1-sulfonic acid All of these compounds have been known already, which can be available in the market or can be produced by known processes for synthesis.

In the present invention, it is preferred to use the above described component (2) in an amount sufficient to make the transmission optical density of the antihalation layer at least 0.1, and preferably at least 0.3, and to make the reflection optical density at least 0.05, and preferably at least 0.1. It is preferred to use as a completely dissociating material a compound such as an alkali metal salt or an ammonium salt, etc. in order to maintain a sufficient optical density while using the minimum amount of the compound. It is further preferred that these salts are used in a presence of a cationic polymer mordant, because a decoloration rate is accelerated and the absorption of the base side of the antihalation layer shifts in a longer wavelength side.

The cationic polymer mordant used in the present invention is a polymer containing quaternary cationic groups and has a molecular weight of 5,000 to 200,000 and preferably 10,000 to 50,000.

Preferred examples of the cationic polymer mordants include vinylpyridinium cationic polymers described in U.S. Pat. Nos. 2,548,564, 2,484,430, 3,148,061 and 3,756,814; polymer mordants capable of cross-linking with a binder (matrix) described in U.S. Pat. Nos. 3,625,694, 3,859,096 and 4,128,538 and British Pat. No. 1,277,453, etc.; aqueous sol type mordants described in U.S. Pat. Nos. 3,958,995, 2,721,852 and 2,798,063, and Japanese Patent Application (OPI) Nos. 115228/79, 145529/79 and 126027/79, etc.; water insoluble mordants described in U.S. Pat. No. 3,898,088; reactive mordants described in U.S. Pat. No. 4,168,976; and mordants described in U.S. Pat. Nos. 3,709,690, 3,788,855, 3,642,482, 3,488,706, 3,557,066, 3,271,147, 3,271,148, and 4,131,469 and Japanese Patent Application (OPI) Nos. 71332/75, 155528/77, 125/78 and 1024/78.

In addition, there are mordants described in U.S. Pat. Nos. 2,675,316 and 2,882,156.

Among these mordants, those which are hard to move into other layers from the antihalation layer in the sensitive material are more preferably used. For example, it is possible to suitably use the mordants which cause a cross-linking reaction with the binder matrix), water insoluble mordants and aqueous sol (or latex dispersion) type mordants.

Particularly preferred cationic polymer mordants are described below.

(1) Polymers having quaternary ammonium groups and groups capable of linking to the binder (for example, aldehyde groups, chloroalkanoyl groups, chloroalkyl groups, vinylsulfonyl groups, pyridinium propionyl groups, vinylcarbonyl groups or alkylsulfonoxy groups, etc.). For example,

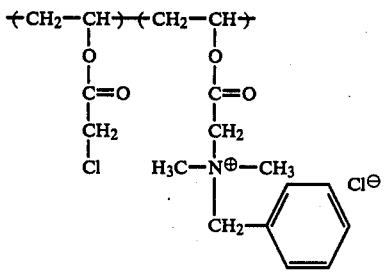

(2) Reaction products of a copolymer composed of a repeating unit of the monomer represented by the following formula and a repeating unit of another ethylenically unsaturated monomer, and a cross-linking agent (for example, bisalkanesulfonate or bisallene sulfonate).

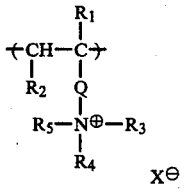

$R_1$: H or an alkyl group
$R_2$: H, an alkyl group or an aryl group
Q: a divalent group
$R_3$, $R_4$ and $R_5$: an alkyl group, an aryl group, or at least two of $R_3$, $R_4$ and $R_5$ may form a heterocyclic ring by linking to each other.
X: an anion;
(the above described alkyl group or aryl group may be substituted).

(3) Polymers represented by the following formula

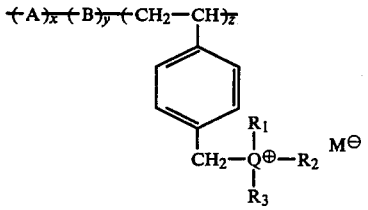

x: about 0.25 to about 5% by mol
y: about 0 to about 90% by mol
z: about 10 to about 99% by mol
A: monomer having at least two ethylenically unsaturated bonds
B: copolymerizable ethylenically unsaturated monomer
Q: N or P
m: an anion
$R_1$, $R_2$ and $R_3$: an alkyl group, a cyclic hydrocarbon group, and at least two of $R_1$, $R_2$ and $R_3$ may form a ring by linking to each other. (these groups and the ring may be substituted).

(4) Copolymers composed of (a), (b) and (c):

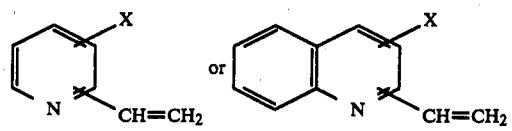

(a)

X: hydrogen, an alkyl group or a halogen atom (the alkyl group may be substituted),
(b) Acrylic acid ester, and
(c) Acrylonitrile.

(5) Water insoluble polymers, more than ⅓ of which are composed of a repeating unit represented by the following formula

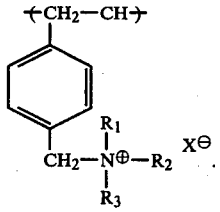

$R_1$, $R_2$ and $R_3$: an alkyl group, respectively, wherein the total of carbon atom numbers in $R_1$, $R_2$ and $R_3$ is 12 or more (The alkyl group may be substituted).

The cationic polymer mordant may be used in a suitable amount. However, it is preferred to use in a range of from 1 wt% to 4000 wt% based on the component (2) and in a range of from 0.1 wt% to 100 wt% based on the binder.

In the present invention, a colored composition prepared by mixing the above described component (1) and component (2) and, preferably, the cationic polymer mordant is applied to form an antihalation layer. The antihalation layer is provided on the opposite side of said heat-developable photosensitive layer with respect to the side intended for imagewise exposure. In greater detail, a layer of the colored composition is provided between the heat-developable photosensitive layer and the base or on the back of the base, or the colored composition is incorporated in the base, by which the base itself can be the antihalation layer. In carrying out application of the antihalation layer, though it is preferred to use a suitable binder, the layer may be formed, if necessary, by applying a solution comprising the components (1) and (2) and, preferably, the cationic polymer mordant (without using the binder). The binder which can be used is the same kind as that used for the heat-developable photosensitive layer, a top coating layer or a subbing layer, as described hereinafter.

The above described antihalation layer is capable of changing its color into a color which is not an obstacle to viewing the images after an image forming processing, by exposing it to a light source having an irradiation energy in an absorption wavelength range of the component (1) (for example, a mercury lamp, a fluorescent lamp for copying, a carbon arc lamp, a fluorescent arc lamp or sunlight, etc.).

Though the exposure depends on the kind of components (1) and (2) and the color density of the antihalation layer, it is generally in a range from $10^4$ ergs/cm·sec to $10^6$ ergs/cm·sec.

The organic silver salt of the heat-developable photosensitive layer used in the present invention is colorless, white or light colored in a normal state, but reacts with the reducing agent to form silver (image) when it is heated to 80° C. or more in a presence of an exposed photocatalyst, which fulfils the function of an image forming component in the heat-developable photo-sensitive material. As such organic silver salts, silver salts of organic compounds having an imino group, a mercapto group, a thione group or carboxy group have been known, and examples have been described, for example, in U.S. Pat. Nos. 3,457,075, 3,549,379, 3,785,830, 3,933,507 and 4,009,039, British Pat. No. 1,230,642, and Japanese Patent Application (OPI) Nos. 93139/75, 99719/75, 22431/76, 141222/77 and 36224/78. In the present invention, these known organic silver salts can be used by suitably selecting from among them.

As preferred organic silver salts used in the present invention, there are silver salts of long chain aliphatic carboxylic acids having from 10 to 40 carbon atoms, and preferably from 18 to 33 carbon atoms, examples of which include silver laurate, silver myristate, silver palmitate, silver stearate, silver arachidate, silver behenate, silver lignocerate, silver pentacosanate, silver cerotate, silver heptacosanate, silver montanate, silver melissate and silver laccerate, etc. These silver salts of aliphatic carboxylic acids may be used together with reactive free aliphatic acids.

In the above described organic silver salts, it is preferred to use those having a particle size of from about 0.01 microns to 10 microns, and preferably from about 0.1 microns to about 5 microns.

The organic silver salt in the present invention is used in an amount of from about 0.1 g to 4 g, and preferably from about 0.2 g to 2.5 g of silver content based on 1 $m^2$ of the base. This amount is necessary and sufficient to give a suitable image density. If the amount is less than the above described range, the image density is insufficient. If it is larger than the above described range, the image density is not increased, but the cost becomes high.

The photocatalyst of the heat-developable photosensitive layer used in the present invention is a substance which changes into a substance catalyzing a silver (image) forming reaction of the organic silver salt with the reducing agent present in the layer under heating to 80° C. or more, or a substance having an ability of releasing such a substance, which functions as a photosensitive component and a catalyst component for the above described silver (image) forming reaction in the heat-developable photosensitive material. Examples of such photocatalysts include inorganic and organic photoconductive substances such as zinc oxide or titanium oxide, etc., photosensitive complexes of silver and dyes, and photosensitive silver salts such as photosensitive silver halide. Generally, they are used in an amount of from about 0.001 mol to 1 mol, and preferably from about 0.01 mol to 0.5 mol, per mol of the organic silver salt.

The most suitable photocatalyst used in the present invention is photosensitive silver halide, examples of which include silver chloride, silver bromide, silver iodide, silver chlorobromoiodide, silver chlorobromide, silver chloroiodide, silver iodobromide and mixtures thereof. Preferred particle size of the photosensitive silver halide is from about 0.05 micron to 0.2 micron.

The photosensitive silver halide used in the present invention can be formed simultaneously with formation of the organic silver salt by introducing a silver ion solution into a mixed solution containing a halogenating agent and an organic silver salt forming component, as described in British Pat. No. 1,447,454.

Further, as another process, a part of the organic silver salt may be converted into the photosensitive silver halide by reacting a photosensitive silver halide forming component with a previously prepared solution or dispersion of the organic silver salt or with a sheet material containing the organic silver salt. Thus formed photosensitive silver halide exhibits a particularly preferred function for the present invention, because it effectively contacts the organic silver salt. The foregoing expression "photosensitive silver halide forming component" refers to a compound capable of forming photosensitive silver halide by reacting with the organic silver salt, and effective compounds corresponding to it can be distinguished by the following simple test. Namely, after an organic silver salt and a compound to be tested are mixed, and, if necessary, heated in order to accelerate the decomposition of the mixture and the reaction of the organic silver salt and the halogen radical (or ion), particular diffraction peaks of silver halide are investigated by X-ray diffractiometry. Examples of photosensitive silver halide forming components whose effectiveness has been ascertained by such a test include inorganic halides, onium halides, halogenated hydrocarbons, N-halogenated compounds, halogen molecules and other halogen containing compounds, examples of which have been described in U.S. Pat. Nos. 4,009,039, 3,457,075 and 4,003,749, British Pat. No. 1,498,956 and Japanese Patent Application (OPI) Nos. 27027/78, 25420/78, 131029/78 and 114419/78.

The photosensitive silver halide forming component is used in a stoichiometrically small amount compared to the amount of organic silver salt. Generally, the amount is settled in a range of from about 0.001 mol to 0.7 mol, and preferably from about 0.01 mol to 0.5 mol per mol of the organic silver salt. Two or more kinds of photosensitive silver halide forming component may be used within the above described range. It is particularly preferred to use oxidative halogen containing compounds such as N-halogen compounds or halogen molecules together with inorganic halides because of showing high sensitivity and low fog.

Further, it is preferred to use an oxidizing agent such as hydrogen peroxide, etc., together with the photosensitive silver halide forming component.

The photocatalyst can be spectrally sensitized by various known dyes. Examples of effective spectral sensitizing dyes include cyanine dyes, merocyanine dyes, rhodacyanine dyes, complex (3 nuclei or 4 nuclei) cyanine or merocyanine dyes, holopolar cyanine dyes, styryl dyes, hemicyanine dyes, oxonol dyes, hemioxonol dyes, and xanthene dyes. As the cyanine dyes, those having a basic nucleus such as a thiazoline nucleus, an oxazoline nucleus, a pyrroline nucleus, a pyridine nucleus, an oxazole nucleus, a thiazole nucleus, a selenazole nucleus, or an imidazole nucleus are preferred. As the merocyanine dyes, those having a thiohydantoin nucleus, a rhodanine nucleus, an oxazolidinedione nucleus, a thiazolidinedione nucleus, a barbituric acid nucleus, a thiazolinone nucleus, a malonitrile nucleus, a tetrazole nucleus, or a pyrazolone nucleus as an acid nucleus together with the above described basic nucleus are preferred. Among them, merocyanine dyes having an imino group or a carboxyl group are particularly effective. More specifically, the dye is suitably selected from known dyes described, for example, in U.S. Pat. Nos. 3,761,279, 3,719,495 and 3,877,943 and British Pat. Nos. 1,466,201, 1,469,117 and 1,422,057, etc., and those dyes can be positioned near the photocatalyst according to the method described above known literatures (or patents). These spectral sensitizing dyes are used in an amount of from about $10^{-4}$ mol to 1 mol per mol of the photocatalyst.

The reducing agent of the heat-developable photosensitive layer used in the present invention is a substance which reacts with the organic silver salt to reduce it when heated to 80° C. or more in a presence of an exposed photocatalyst, which functions as an oxidation-reduction image forming composition together with the organic silver salt in the heat-developable photosensitive material. A suitable reducing agent is decided on the basis of the kind and properties of the organic silver salt used. For example, a reducing agent having a high reducing ability is suitable for organic silver salts which are difficult to reduce, and a reducing agent having a low reducing ability is suitable for organic silver salts which are easily reduced.

Examples of generally known reducing agents used for the heat-developable photosensitive material include monophenols, polyphenols having two or more phenol groups, mononaphthols, bisnaphthols, polyhydroxybenzenes having two or more hydroxyl groups, polyhydroxynaphthalene having two or more hydroxyl groups, ascorbic acid compounds, 3-pyrazolidones, pyrazoline-5-ones, pyrazolones, phenylenediamines, hydroxylamines, hydroquinone monoethers, hydroxamic acids, hydrazides, amidoximes and N-hydroxyureas, etc. In more detail, such reducing agents are described, for example, in U.S. Pat. Nos. 3,615,533, 3,679,426, 3,672,904, 3,751,252, 3,782,949, 3,801,321, 3,794,949, 3,801,321, 3,794,488, 3,893,863, 3,887,376, 3,770,448, 3,819,382, 3,773,512, 3,928,686, 3,839,048, 3,887,378, 4,009,039 and 4,021,249, British Pat. No. 1,486,148, Belgium Pat. No. 786,086, Japanese Patent Application (OPI) Nos. 36143/75, 36110/75, 116023/75, 99719/75, 140113/75, 51933/76, 23721/76 and 84727/77, and Japanese Patent Publication No. 35851/76. The reducing agent used in the present invention can be suitably selected from these known reducing agents. It is believed that the simplest method of selection is that which comprises producing a heat-developable photosensitive material and examining superiority or inferiority of the reducing agent used by evaluating photographic properties of the heat-developable photosensitive material. Many useful materials have been developed in the art by this method.

The amount of the reducing agent used in the present invention varies according to the kinds of the organic silver salt and the reducing agent and use of other additives, but it is generally in a range of from about 0.05 mol to 10 mols and, preferably, from about 0.1 to 3 mols, per mol of the organic silver salt. Further, two or more kinds of reducing agent may be used together with the above described range.

It is desirable to use a toning agent, a tone affording agent or an additive called an activator toner (referred to simply as the toner hereinafter) together with the above described each component. The toner has a function of increasing density, and, particularly, blackening the formed image by participating in an oxidation-reduction silver (image) forming reaction of the organic silver salt with the reducing agent. As the toner, many compounds are known already, most of which are compounds having an imino group, a mercapto group, or a thione group. A suitable toner is selected from them according to the kinds of the organic silver salt and the reducing agent. Examples of toners which show a suitable toning effect in the present invention include phthalazinones (for example, phthalazinone, 2-acetylphthalazinone and 2-carbamoyl phthalazinone, etc.) described in U.S. Pat. Nos. 3,152,904, 3,844,797 and 4,076,534. In addition, there are heterocyclic compounds described in U.S. Pat. Nos. 3,846,136, 4,030,930, 3,846,136, 3,951,660 and 3,885,967, Japanese Patent Application (OPI) No. 76020/78, and U.S. Pat. No. 3,782,941. These toners may be used as a combination of two or more thereof.

Further, phthalic acid, naphthoic acid or phthalamic acid and imidazoles or phthalazinones may be used together as the toner, as described in U.S. Pat. Nos. 3,847,612 and 3,994,732.

When using toner, it is preferred to use it in an amount of from about 0.0001 mol to 2 mols, and, preferably, from 0.0005 mol to 1 mol, per mol of the organic silver salt.

In order to remove fog generating on the non-image area during heat development (referred to as heat-fog hereinafter), it is possible to use various compounds in the present invention.

Suitable anti-heat-fogging agents include (1) N-halogenated compounds (for example, N-halogenosuccinimide and N-halogenoacetamide) described in U.S. Pat. Nos. 3,957,493 and 4,055,432, (2) perchlorates, peroxides and persulfates, described in British Pat. Nos. 1,455,271 and 1,460,868, (3) lithium salts of aliphatic acids, described in U.S. Pat. No. 3,885,968, (4) rhodium salts, iron salts, cobalt salts, nickel salts and palladium salts described in British Pat. Nos. 1,480,704 and 1,502,670 and Japanese Patent Application (OPI) No. 134421/75, (5) polymer acids (for example, polyacrylic acid) described in U.S. Pat. No. 4,039,334 and Japanese Patent Application (OPI) No. 104338/76, (6) 1,2,4-triazoles described in Japanese Patent Application (OPI) No. 32015/78, (7) the above described sulfinic acids and/or thiosulfonic acids, (8) the above described disulfides, (9) above described sulfur simple substance, (10) cerium compounds described in Japanese Patent Application (OPI) No. 24520/77, and (11) mercapto compounds and thiones useful for gelatine-silver halide. Among them, thiosulfonic acids of (7), sulfur simple substance of (9), cerium compounds of (10), 1,2,4-triazoles of (6) and mercapto compounds and thiones of (11) show very useful effects.

The above-described ingredients of the present invention are preferred to be dispersed in at least one kind of colloid as a binder. Preferred binders are hydrophobic polymeric materials. However, if desired, hydrophilic polymeric materials may be used alone or together with the above described binders. It is preferred that the polymeric materials used as the binder be those which form a transparent or semitransparent colorless layer or membrane when they are applied. Examples thereof include proteins such as gelatine, cellulose derivatives, polysaccharides such as dextran and natural polymeric materials such as gum arabic, and synthetic high molecular materials described in U.S. Pat. No. 4,009,039 and Japanese Patent Application (OPI) Nos. 126408/75, 29126/76, 19525/76 and 84443/74. Among them, it is preferred to use polyvinyl butyral, polyvinyl acetate, ethyl cellulose, vinylidene chloridevinyl chloride copolymer, polymethyl methacrylate, vinyl chloride-vinyl acetate copolymer, cellulose acetate butyrate, and gelatine.

As the base used in the present invention, it is preferred to use materials capable of forming a sheet or roll. Accordingly, as the base used in the present invention, it is particularly preferred to use plastic films (for example, a cellulose acetate film, a polyester film, a polyethylene terephthalate film, a polyamide film, a polyimide film, a triacetate film or a polycarbonate film) and papers (conventional paper as well as photographic base paper, printing base paper such as coated paper or art paper, baryta paper, resin coated paper, paper sized with polysaccharide described in Belgian Pat. No. 784,615, pigmented paper containing pigments such as titanium dioxide and paper sized with polyvinyl alcohol).

In the heat-developable photosensitive materials of the present invention, it is possible to provide various assistant layers, for example an antistatic layer or a subbing layer, as described in Japanese Patent Application (OPI) No. 87721/78, in addition to the antihalation layer. Further, it is preferred to provide a protective polymer layer as described in U.S. Pat. Nos. 3,933,508, 3,856,526, 3,856,527 and 3,893,860, because the layer provides an effect of increasing transparency of each layer provided on the base and improving moisture resistance and heat resistance of the layer. The protective polymer layer is preferred to have a film thickness of from about 0.1 micron to 20 microns. Preferred polymers in the protective polymer layer are those described in the above cited patent specifications. Among them, it is particularly preferred to use polyvinyl chloride, polyvinyl acetate, vinyl chloride-vinyl acetate copolymer, polystyrene, methyl cellulose, ethyl cellulose, cellulose acetate butyrate, vinyl chloride-vinylidene chloride copolymer, carboxy esters, acetyl cellulose, polyvinylidene chloride, polycarbonate, gelatine, polyvinyl alcohol and polyvinyl butyral, etc. It is preferred to harden by an isocyanate group containing compound or another suitable hardening agent.

The membrane or layer containing each component of the present invention and the assistant layer may contain additives known in the field of heat-developable photosensitive materials, for example, plasticizers, matting agents, surface active agents, sensitizers, whitening agents, filter dyes, ultraviolet ray absorbing agents, hardening agents, lubricants and development accelerators, etc. These additives and use thereof have been described in Product Licensing Index, Vol. 92 (Dec. 1971) No. 9232, page 107, Japanese Patent Application (OPI) Nos. 33615/78, 119623/75, 57619/75 and 27923/76 and U.S. Pat. Nos. 3,769,019, 3,821,001, 3,667,959, 3,871,887, 3,885,965, 4,021,250 and 4,036,650.

A process for preparing the heat-developable photosensitive material of the present invention is summarized as follows. Namely, a silver halide is produced simultaneously with an organic silver salt, or a part of the organic silver salt is converted into silver halide, as a preferable process, by a silver halide forming component in a presence of the binder. In the case of using a sensitizing dye, it is preferred to add it in the form of a solution to the mixture. The organic silver salt and the silver halide are suitably prepared as a polymer dispersion by dispersing them in a solution of a polymeric material which functions as a binder thereafter. This polymer may be added at a suitable time, for example, at preparation of the organic silver salt or at formation of silver halide. The polymer dispersion of the organic silver salt and the silver halide may be molded to form a membrane or applied to a base to form a layer, and other components of the present invention are incorporated in a layer provided on said membrane or layer. However, preferably, if necessary, the various additives are added to the polymer dispersion of the organic silver salt and the silver halide to prepare a heat-developable photosensitive composition, which is then followed by a known method to form a membrane or is applied to a base to form a layer. In order to apply the layer, it is possible to apply various known coating methods, such as a dipping method, an air knife method, a curtain coating method, or a hopper coating method, etc. Prior to, simultaneously with, or after the application of the above described composition, the antihalation layer of the present invention and various auxiliary layers such as a subbing layer or a protective coating layer, etc. can be applied by the similar coating method. If desired, the light-bleachable composition of the present invention may be incorporated in the base, by which the base itself can be the antihalation layer.

Though any solvent can be used for the coating solutions, non-combustible solvents as described in British Pat. No. 1,422,145 can be used to avoid the hazard of fire.

If desired, the surface or the back of the base or the layer applied to the base may be subjected to printing, by which printed goods can be used as railway tickets (commutation tickets), postcards and other documents.

The thus produced heat-developable photosensitive material is imagewise exposed to light before or after cutting in a suitable size for using. If desired, it may be preheated (80° C.–140° C.) before exposure. As light sources suitable for imagewise exposure, there are tungsten lamps, fluorescent lamps used for exposing diazo-photosensitive materials, mercury lamps, iodine lamps, xenon lamps, CRT (cathode ray tube) and laser light sources, etc. As the original, not only line drawings such as drafts but also photographic images having gradation can be used. Furthermore, it is possible to take a photograph of a human figure or a landscape by means of a camera. As a printing method, it is possible to utilize contact printing by superposing the original, reflection printing, and enlargement printing. The exposure varies according to the sensitivity of the photosensitive material. In the case of high sensitivity, it is about 1 lux second, and in the case of low sensitivity, it is about $10^3$ luxes second. The imagewise exposed photosensitive material can be developed solely by heating (preferably from about 100° C. to about 150° C.). The heating time can be suitably controlled, for example, from 1 second to 60 seconds. It depends upon the heating temperature. Generally, a suitable heating time is from about 5 seconds to 40 seconds at 120° C., from about 2 seconds to 20 seconds at 130° C., and from about 1 second to 10 seconds at 140° C. Various heating means can be used. For example, the photosensitive material may be brought into contact with a heated simple plate or with a heated drum, and, if desired, it is passed through a heated space. Further, it may be heated by high frequency induction heating or by laser beams.

It is then exposed to the light of a mercury lamp or a fluorescent lamp (e.g. for copying) to bleach the antihalation layer. Other light sources may be used for light-bleaching or light-migration, if they have an irradiation energy in the absorption wavelength range of the photosensitive halogen containing compound of the component (1), and the bleaching can be carried out by sunlight, a carbon arc lamp, light table (using a fluorescent lamp), or, if desired, by room light.

Since the antihalation layer of the present invention has an excellent antihalation ability, sharp images are obtained, and the color of the layer rapidly changes by light exposure after processing, by which the color is not an obstacle to viewing the images. Further, this effect deteriorates less during preservation of the sensitive material just after coating. Furthermore, it does not have an adverse influence upon other photographic properties, for example, heat fog or light-discoloration, etc.

In the following, the present invention is illustrated in greater detail by reference to examples.

EXAMPLE 1

| | |
|---|---|
| Silver behenate (containing 20% by mol of free stearic acid) | 76 g |
| Polyvinyl butyral | 80 g |
| Isopropyl alcohol | 200 g |
| n-Butyl acetate | 200 g |

The above described composition was dispersed by a homogenizer to prepare a polymer dispersion of silver salt.

This polymer dispersion of silver salt was kept at 50° C. After adding the following solution, the mixture was heated for 90 minutes to convert a part of silver behenate into silver bromide.

| | |
|---|---|
| N—Bromosuccinimide | 4 g |
| Acetone | 100 ml |

The resulted polymer dispersion of silver behenatesilver bromide was kept at 40° C., and the following compounds were added thereto at intervals of 5 minutes to prepare a coating solution.

| | | |
|---|---|---|
| (1) | Sodium benzenethiosulfonate (0.05 wt % solution in ethanol) | 18 ml |
| (2) | Phthalic acid (4 wt % solution in ethanol) | 25 ml |
| (3) | 3,4-Dichlorobenzoic acid (3 wt % solution in ethanol) | 25 ml |
| (4) | Reducing agent having the following formula (16 wt % solution in acetone) | 140 ml |

-continued

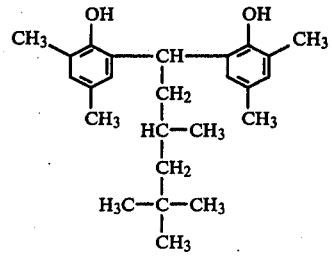

| | | |
|---|---|---|
| (5) | Sensitizing dye (following formula) (0.1 wt % solution in ethylene glycol monomethyl ether) | 35 ml |

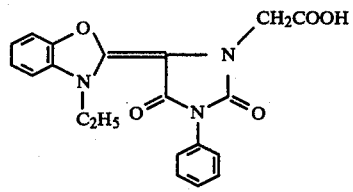

| | | |
|---|---|---|
| (6) | Phthalazinone (toner) (6 wt % solution in ethylene glycol monomethyl ether) | 140 ml |
| (7) | Hexamethylenediisocyanate (hardening agent) (1 wt % solution in n-butyl acetate) | 40 ml |

The thus prepared coating solution was applied to a polyethylene terephthalate film base so as to result in a silver content of 1.5 g/m$^2$.

Further, as a protective coating layer, a 2 wt% solution of cellulose diacetate in acetone was applied so as to obtain 0.5 g of polymer per m$^2$. The thus prepared heat-developable photosensitive material is referred as "Photosensitive material A" hereinafter.

On the other hand, an antihalation layer having the following composition was applied to the back of the polyethylene terephthalate film base so as to result in a density at the maximum absorption wavelength of each component (2) used, by the same manner as in the Photosensitive material A to produce Photosensitive materials B–K.

| | | |
|---|---|---|
| (i) | Cellulose diacetate | 5 g |
| (ii) | Poly(tri-n-hexyl-vinylbenzylammonium chloride) | 0.6 g |
| (iii) | Component (1) of the present invention described in Table 1 | Shown in Table 1 |
| (iv) | Component (2) of the present invention described in Table 1 | Shown in Table 1 |
| (v) | Acetone | 61 ml |
| (vi) | Ethyleneglycol monomethyl ether | 5 ml |

After photosensitive materials A–K were exposed to light using a light source having a maximum intensity at 450 nm, they were developed with heating to 130° C. for 16 seconds. The wedge used was a strip wedge having black intervals of 100$\mu$.

TABLE 1

| Photo-sensitive material | Composition of antihalation layer: Component (1) (Amount added) | Composition of antihalation layer: Component (2) (Amount added) | Maximum absorption wavelength (nm) / Density of antihalation layer | Processing condition: Distance from light source (cm) / Exposure time (second) | Results: Blackening of parts covered with optical wedge (100μ) | Results: Color of background | Results: (Maximum absorption wavelength (nm) / Density of antihalation layer) |
|---|---|---|---|---|---|---|---|
| A | None | None | — / — | — / — | Blackening | No color | — / — |
| B | 2-Trichloromethyl-5-(4-n-butoxystyryl)-1,3,4-oxadiazole (7.24 wt % solution in methyl ethyl ketone 6 ml) | Na salt of 2-{2-(2,4-di-t-amylphenoxy)butanamido}-4-nitrophenol (0.025N solution in methanol 8 ml) | 448 / 0.4 | 10 / 7 | No blackening | " | (448 / 0.00) |
| C | The same as B / The same as B | Na salt of 2,6-Di-t-butyl-4-nitrophenol (0.025N solution in methanol 8 ml) | 462 / 0.6 | 10 / 7 | " | " | (462 / 0.00) |
| D | The same as B / The same as B | Na salt of 8-hydroxy-5-nitroquinoline (0.01N solution in methanol 16 ml) | 465 / 0.8 | 10 / 8 | " | " | (465 / 0.00) |
| E | The same as B / The same as B | Na salt of 2-formyl-6-methoxy-4-nitrophenol (0.02N solution in methanol 12 ml) | 428 / 0.5 | 10 / 12 | " | Light yellow | (428 / 0.10) |
| F | The same as B / The same as B | Na salt of 2,6-dinitrophenol (0.01N solution in methanol 3 ml) | 450 / 0.3 | 10 / 12 | " | " | (450 / 0.05) |
| G | The same as B / The same as B | Na salt of 4-nitronaphthol (0.1N solution in methanol 1.8 ml) | 488 / 0.3 | 10 / 8 | " | " | (488 / 0.10) |
| H | The same as B / The same as B | Na salt of 4-(2,4-dichloro-phenylazo)phenol (0.025N solution in methanol 7.2 ml) | 476 / 0.3 | 10 / 12 | " | " | (476 / 0.05) |
| I | The same as B / The same as B | 2-(4-Hydroxyphenylazo)-benzene-1-sodium sulfonate (0.025N solution in methanol 4 ml) | 424 / 0.3 | 3 / 12 | " | " | 424 / 0.05 |

TABLE 1-continued

| Photo-sensitive material | Composition of antihalation layer: Component (1) (Amount added) | Component (2) (Amount added) | Maximum absorption wavelength (nm) / Density of antihalation layer | Processing condition: Distance from light source (cm) / Exposure time (second) | Results: Blackening of parts covered with optical wedge (100μ) | Color of background | (Maximum absorption wavelength (nm) / Density of antihalation layer) |
|---|---|---|---|---|---|---|---|
| J | 2,4,6-Tris-trichloromethyl-1,3,5-triazine (3.12 wt % solution in methyl ethyl ketone 14 ml) | The same as B / The same as B | 448 / 0.3 | 3 / 12 | " | No color | (448 / 0.00) |
| K | 2,4-Bis-trichloromethyl-6-phenyl-1,3,5-triazine (2.82 wt % solution in methyl ethyl ketone 14 ml) | The same as B / The same as B | 448 / 0.3 | 3 / 12 | " | " | (448 / 0.00) |

In the developed photosensitive material A, a considerable degree of blackening was observed on the part corresponding to the black intervals of 100μ of the wedge which essentially could not be exposed. It is evidently supposed that development is caused because of exposure to reflection light by halation. On the contrary, in the "photosensitive materials B–K", distinct non-exposed fine lines of 100μ were produced without causing blackening (refer to Table 1). The image in that state was difficult to see, because the non-exposed parts were colored. However, when these photosensitive materials B–K were exposed to light using a 1 kW mercury lamp at a distance shown in Table 1 for a period of time shown in the same table, the color was easily bleached to become light-colored or colorless (refer to Table 1). Thus, an image having high sharpness could be formed on a light-colored or colorless background according to the present invention.

While the invention has been described in detail and with reference to specific embodiments thereof, it will be apparent to one skilled in the art that various changes and modifications can be made therein without departing from the spirit and scope thereof.

What is claimed is:

1. A heat-developable photosensitive material comprising:

a heat-developable photosensitive layer comprised of an organic silver salt, a photocatalyst, and a reducing agent; and an antihalation layer provided on the opposite side of said heat-developable photosensitive layer with respect to the side intended for imagewise exposure, wherein said antihalation layer is comprised of a photosensitive halogen-containing compound capable of reducing the pH of said antihalation layer by photolysis, said antihalation layer being colored with a dye which changes color when the pH of said antihalation layer is reduced.

2. A heat-developable photosensitive material, as claimed in claim 1, wherein said photosensitive halogen-containing compound is a compound represented by the formula (I):

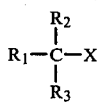

(I)

wherein X represents a halogen atom, $R_1$, $R_2$ and $R_3$, are independently hydrogen, a halogen atom, a nitro group, an alkyl group having from 1 to 10 carbon atoms, an aryl group having from 6 to 14 carbon atoms, an alkylcarbonyl group having from 2 to 11 carbon atoms, and arylcarbonyl group having from 7 to 15 carbon atoms, an amido group substituted with an alkyl group having from 1 to 10 carbon atoms or an aryl group having from 6 to 14 carbon atoms, or a sulfonate group substituted by an alkyl group having from 1 to 10 carbon atoms or an aryl group having from 6 to 14 carbon atoms, and $R_1$ and $R_2$ together can also form a cycloalkyl ring by linking to each other.

3. A heat-developable photosensitive material, as claimed in claim 1, wherein said photosensitive halogen-containing compound is a compound of formula (II):

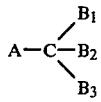

(II)

wherein A is a heterocyclic ring, $B_1$, $B_2$ and $B_3$ are independently, hydrogen, chlorine or bromine, provided that one of $B_1$, $B_2$ or $B_3$ is a chlorine atom or a bromine atom.

4. A heat-developable photosensitive material, as claimed in claim 1, wherein said photosensitive halogen-containing compound is a compound having the formula (III):

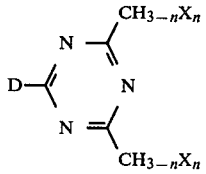

(III)

wherein D is an alkyl group having from 1 to 5 carbon atoms, and may be substituted by halogen atoms or an aryl group having from 6 to 10 carbon atoms, X is a halogen atom, and n is an integer selected from the group consisting of 1, 2 and 3.

5. A heat-developable photosensitve material, as claimed in claim 1, wherein said photosensitive halogen-containing compound is a compound having the formula (IV):

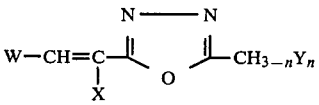

(IV)

wherein W is a substituted or unsubstituted phenyl group or a substituted or unsubstituted naphthyl group, and wherein said phenyl group may be substituted with halogen atoms, a nitro group, a cyano group, an alkyl group having from 1 to 3 carbon atoms or an alkoxy group having from 1 to 4 carbon atoms, X is a hydrogen atom, an alkyl group having 1 to 3 carbon atoms or a phenyl group, and Y is a halogen atom.

6. A heat-developable photosensitive material as claimed in any of claims 1, 2, 3, 4 or 5, wherein said photosensitive halogen-containing compound is contained in an amount of from about 0.1 mol to about 100 mols per mol of said dye.

7. A heat-developable photosensitive material as claimed in claim 6, wherein said photosensitive halogen-containing compound is contained in an amount of 0.5 mol to 10 mols per mol of said dye.

8. A heat-developable photosensitive material, as claimed in claim 7, wherein said dye is contained in an amount sufficient to make the transmission optical density of the antihalation layer at least 0.1, and to make the reflection optical density at least 0.05.

9. A heat-developable photosensitive material, as claimed in claim 8, wherein said transmission optical density is at least 0.3 and the reflection optical density is at least 0.1.

10. A heat-developable photosensitive material, as claimed in claim 1, wherein said dye is a dye which has an absorption in the sensitive wavelength range of the heat-developable photosensitive layer in an ordinary state before thermal development, but has a property that the maximum wavelength thereof shifts in a shorter wavelength side or a longer wavelength side to cause the change of color when the pH of the antihalation layer is reduced.

11. A heat-developable photosensitive material, as claimed in claim 1 or 10, wherein said dye is a pH indicator.

12. A heat developable photosensitive material, as claimed in claim 1, or 10, wherein said dye is (1) Cyanine
(2) Quinaldine Red
(3) Neutral Red
(4) Curcumin
(5) Haematoxylin
(6) Alizarin
(7) Methyl Orange
(8) Ethyl bis-2,4-dinitrophenyl acetate
(9) o-Cresolphthalein
(10) Phenolphthalein
(11) Thymolphthalein
(12) Tetrabromophenolsulfonphthalein
(13) Dibromodichlorophenolsulfonphthalein
(14) Thymolsulfonphthalein
(15) 1,4-Dimethyl-5-hydroxybenzenesulfonphthalein
(16) m-Cresolsulfonphthalein
(17) o-Cresolsulfonphthalein or
(18) Dibromo-o-cresolsulfonphthalein.

13. A heat developable photosensitive material, as claimed in claim 1, or 10, wherein said dye is a compound represented by formula (V):

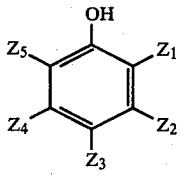

(V)

wherein $Z_1$, $Z_2$, $Z_3$, $Z_4$ and $Z_5$, which may be identical or different, each represents hydrogen, a halogen atom, a cyano group, —CH=N—OH, a carboxy group, a sulfo group, an alkyl group, an acyl group, an alkoxy group, an amido group, a carbamoyl group, a sulfonyl group, a sulfonamido group, a sulfamoyl group, an aryl group or a nitro group, provided that at least one of $Z_1$, $Z_2$, $Z_3$, $Z_4$ and $Z_5$ is a nitro group; and $Z_1$ and $Z_2$, or $Z_2$ and $Z_3$ together may form a ring by linking to each other.

14. A heat developable photosensitive material, as claimed in claim 1, or 10, wherein said dye is a compound represented by formula (VI):

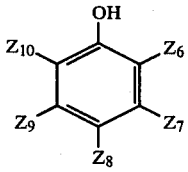

(VI)

wherein $Z_6$, $Z_7$, $Z_8$, $Z_9$ and $Z_{10}$ which may be identical or different, each represents hydrogen, a halogen atom, a cyano group, —CH=N—OH, a carboxyl group, a sulfo group, an alkyl group, an acyl group, an alkoxy group, an amido group, a carbamoyl group, a sulfonyl group, a sulfonamido group, a sulfamoyl group, an aryl group or a nitro group, provided that at least one of $Z_6$ and $Z_8$ represents a phenylazo group.

15. A heat developable photosensitive material, as claimed in claim 1, wherein said antihalation layer further contains a cationic polymer mordant.

16. A heat developable photosensitive material, as claimed in claim 15, wherein said cationic polymer mordant is a polymer containing quaternary cationic groups and has a molecular weight of 5,000 to 200,000.

17. A heat developable photosensitive material, as claimed in claim 15 or 16, wherein said cationic polymer mordant is a polymer having quaternary ammonium groups and groups capable of linking to the binder.

18. A heat developable photosensitive material, as claimed in claim 15 or 16, wherein said cationic polymer mordant is a reaction product of a copolymer composed of a repeating unit of the monomer represented by the following formula and a repeating unit of another ethylenically unsaturated monomer, and a cross-linking agent:

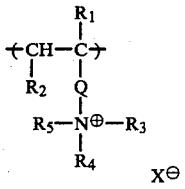

$R_1$: H or an alkyl group
$R_2$: H, an alkyl group or an aryl group
Q: a divalent group
$R_3$, $R_4$ and $R_5$: an alkyl group, an aryl group, or at least two of $R_3$, $R_4$ and $R_5$ may form a heterocyclic ring by linking to each other
X: an anion.

19. A heat developable photosensitive material, as claimed in claim 15 or 16, wherein said cationic polymer mordant is a polymer represented by the following formula:

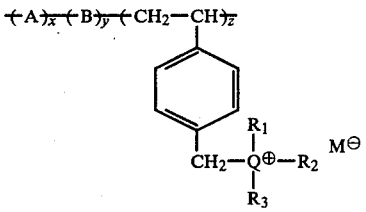

x: about 0.25 to about 5% by mol
y: about 0 to about 90% by mol
z: about 10 to about 99% by mol
A: monomer having at least two ethylenically unsaturated bonds
B: copolymerizable ethylenically unsaturated monomer
Q: N or P
M: an anion
$R_1$, $R_2$ and $R_3$: an alkyl group, a cyclic hydrocarbon group, and at least two of $R_1$, $R_2$ and $R_3$ may form a ring by linking to each other.

20. A heat developable photosensitive material, as claimed in claim 15 or 16, wherein said cationic polymer mordant is a copolymer composed of (a), (b) and (c):

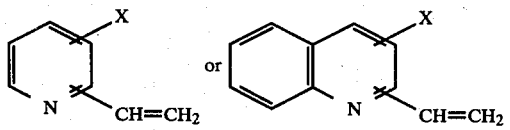

(a)

X: a hydrogen atom, an alkyl group or a halogen atom, (b) Acrylic acid ester, and (c) Acrylonitrile.

21. A heat developable photosensitive material, as claimed in claim 15 or 16, wherein said cationic polymer mordant is a water insoluble polymer, more than $\frac{1}{3}$ of which is composed of a repeating unit represented by the following formula:

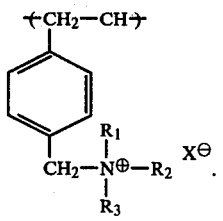

$R_1$, $R_2$ and $R_3$: an alkyl group, respectively, wherein the total of carbon atom numbers in $R_1$, $R_2$ and $R_3$ is 12 or more.

22. A heat developable photosensitive material, as claimed in claim 15, wherein said cationic polymer mordant is used in a range of from 1 wt% to 4000 wt% based on the dye.

23. A heat developable photosensitive material, as claimed in claim 16, wherein said polymer has a molecular weight of 10,000 to 50,000.

* * * * *